US005236818A

United States Patent [19]

Carlson

[11] Patent Number: 5,236,818

[45] Date of Patent: Aug. 17, 1993

[54] ANTISTATIC COATINGS

[75] Inventor: Robert L. Carlson, St. Paul, Minn.

[73] Assignee: Minnesota Mining and Manufacturing Company, St. Paul, Minn.

[21] Appl. No.: 970,495

[22] Filed: Nov. 2, 1992

[51] Int. Cl.[5] ..... G03C 1/85

[52] U.S. Cl. ..... 430/527; 430/530; 428/922; 427/393.1

[58] Field of Search ..... 427/393.1; 430/527, 430/530; 252/521; 428/922

[56] References Cited

U.S. PATENT DOCUMENTS

| | | | |
|---|---|---|---|
| 3,492,137 | 1/1970 | Iler | 106/74 |
| 3,615,781 | 10/1971 | Schneider et al. | 106/84 |
| 4,266,016 | 5/1981 | Date et al. | 430/527 |
| 4,267,266 | 5/1981 | Shibue et al. | 430/527 |
| 4,495,276 | 1/1985 | Takimoto et al. | 430/527 |
| 4,863,801 | 9/1989 | Vallarino | 428/414 |
| 4,895,792 | 1/1990 | Aizawa et al. | 430/527 |

FOREIGN PATENT DOCUMENTS

| | | | |
|---|---|---|---|
| 0301827A2 | 5/1989 | European Pat. Off. . | |
| 334400 | 9/1989 | European Pat. Off. | 430/527 |
| 55-126239 | 9/1980 | Japan | 430/527 |
| 58-062648 | 4/1983 | Japan | 430/527 |
| 3-271732 | 12/1991 | Japan | 430/527 |
| 2075208 | 11/1981 | United Kingdom | 430/527 |
| 2094013 | 9/1982 | United Kingdom | 430/527 |

*Primary Examiner*—Michael Lusigan
*Assistant Examiner*—Erma Cameron
*Attorney, Agent, or Firm*—Gary L. Griswold; Walter N. Kirn; Mark A. Litman

[57] ABSTRACT

A coating of a mixture of sodium orthosilicate together with a silica sol and a silane coupling agent provides antistatic protection when overcoated with a gelatin containing photographic construction.

20 Claims, No Drawings

ANTISTATIC COATINGS

BACKGROUND OF THE INVENTION

1. Field of the Invention

The present invention relates to the prevention of static buildup on polymeric materials by the addition of antistatic layers to those materials. In particular, the invention relates to antistatic coatings in association with imageable materials.

2. Background of the Art

Many different polymeric materials have been long recognized as suffering from electrostatic charge buildup during use. The problems associated with such static charging may be as modest as sparks from moving about on polymeric carpeting and popping sounds on phonograph records or as serious as memory erasure on computer disks and false artifacts in photographic film.

One usual method of reducing static buildup is the addition of a conductive layer or low surface resistivity layer to the polymeric article. It is common in the protection of shaped polymeric articles, including carpets, to treat the polymer with reactive or absorbable salts (e.g., U.S. Pat. No. 3,309,223 and 4,313,978). It is also known to form layers of inorganic metal oxides, either in film or particulate form to decrease the surface resistivity (e.g., U.S. Pat. Nos. 4,203,769 and 4,394,441). These antistatic coatings are known to be particularly desirable and useful as subbing layers in photographic articles (e.g., U.S. Pat. No. 3,874,879).

One other antistatic layer for photographic materials is described in EPO Application 0 301 827 A2 published Feb. 1, 1989 where a continuous gelled network of inorganic oxide particulates, including silica, are coated onto a substrate along with an ambifunctional silane to increase the wet adhesion of the antistatic layer to gelatin. These coatings tend to lose their antistatic properties when overcoated with a photographic construction because of penetration of gelatin into the pores of the layer.

SUMMARY OF THE INVENTION

A coating composition comprising sodium orthosilicate, colloidal inorganic oxide particulates such as silica, and a coupling agent (silane) is applied to substrates to provide an antistatic layer. The orthosilicate provides an essentially continuous network or phase in the interstices of the particles which prevents extensive penetration of the space between colloidal silica so that antistatic properties can be maintained, even after a further coating is applied to the antistatic layer. Such further coating may be gelatin layers such as photographic emulsion layers or auxiliary photographic layers.

DETAILED DESCRIPTION OF THE INVENTION

The antistatic coatings of the present invention are particularly beneficial and capable of a broad range of use at least in part because of their optical transparency when overcoated, water-insolubility, and ability to dissipate a static charge even after being overcoated. Optical transparency is important when the protected substrate or article is to be imaged, viewed, or projected. Water insolubility is significant where the antistatic layer is a surface layer or the article is to be treated or processed in aqueous solutions. Dissipation of a static charge is an indication of the degree of efficiency which the antistatic layer is capable of providing.

The antistatic protective layer of the present invention comprises a layer of at least three components. The three components are in a single coating composition and comprise 1) an alkali metal orthosilicate, 2) colloidal silica particles and 3) coupling agents capable of reacting with the silica particles (a compound having at least two groups one of which is capable of bonding with inorganic oxide particles).

The coupling agents are materials well known in the art, as represented by EPO Application 0 301 827 A2. Those silanes are ambifunctional silane coupling agents represented by the formula:

$$(Q)_n—R—Si(OR^1)_3$$

Wherein $R^1$ is alkyl or aryl,

R is an organic group with (n+1) external bonds or valences, n is 0, 1 or 2, and Q is a moiety reactive with photographic hardeners or directly with gelatin (e.g., alpha-amino acids).

Preferably $R^1$ is alkyl of 1 to 10 carbon atoms and most preferably 1 to 4 carbon atoms. R is preferably an aliphatic or aromatic bridging group such as alkylene, arylene, alkarylene, or aralkylene which may be interrupted with ether linkages (oxygen or thioethers), nitrogen linkages, or other relatively inert moieties. More preferably R is alkylene of 1 to 12 carbon atoms, preferably 2 to 8 carbon atoms, with n equal to 1. Q is preferably epoxy, or amino, primary or secondary, more preferably primary amino.

Where previously indicated that the second functional group may be present as a multiple number of such groups it is meant that the moiety (Q)n-R- may include moieties such as $$NH_2—(CH_2)_2—NH(CH_2)_2—NH—(CH_2)_3—$$

$$NH_2—(CH_2)_3—$$

$$(NH_2)_2—CH—CH_2$$

$$\begin{array}{l} (NH_2)—CH_2 \\ \qquad\qquad \diagdown \\ \qquad\qquad\quad CH— \\ \qquad\qquad \diagup \\ (NH_2)—CH_2 \end{array}$$

and the like.

U.S. Pat. No. 4,879,175 also extensively describes coupling agents, particularly commercially available titanate and silane coupling agents.

One measurement of antistatic property is the surface resistivity of a coating. The units for measuring surface resistivity are ohms per square. The measurement relates to the ability of the coating to dissipate surface static electric charges. The lower the resistivity, the better that property is. Surface resistivity numbers in the $10^9$–$10^{11}$ ohms/sq range are considered to be good, for static protection. The other measurement used in determining antistatic protection is that of charge decay. In measuring this quality, an electric charge (measured in volts) is applied to the surface of the film and the time in seconds for the electric field generated to decay to zero is measured. For excellent static protection, the charge decay time (+5000 v to '0') should be less than two seconds, and preferably less than 0.1 second. In this case, poorly conductive coatings are applied over the antistatic coating. Obviously, low surface resistivity is not directly important in this application because the surface of the antistatic coating is buried under non-conducting materials. Nevertheless, static protection is provided in an indirect manner insofar as the conductive layer is able to neutralize the external electric field of the surface static charges by formation of an internal electric field. This type of protection is effective for, e.g., the prevention of 'static cling' between sheets and with dust particles. This type of static protection is particularly notable in some commercial film, which have relatively poor surface resistivity ($10^{13}$ ohms/sq), but extremely low charge decay times. Other new photographic films have both good charge decay and surface resistivity properties.

An important distinction among antistatic coatings is the type of conductor. They can be either ionic conductors or electronic conductors. In general, if the surface resistivity and charge decay properties depend on the amount of moisture in the air, the coating is termed an ionic conductor, and if the properties do not depend on humidity, it is an electronic conductor.

The colloidal inorganic oxide solution or dispersion used in the present invention comprises finely divided solid silica particles mixed with sodium orthosilicate in a liquid. The term "solution" as used herein includes dispersions or suspensions of finely divided particles of ultramicroscopic size in a liquid medium. The solutions used in the practice of this invention are clear to milky in appearance.

The colloidal coating solution preferably contains about 0.5 to 5.0 weight percent, more preferably about 2.0 to 4.0 weight percent, colloidal silica particles and sodium orthosilicate. At particle concentrations above about 5 weight percent, the resulting coating may have reduced uniformity in thickness and exhibit opacity and reduced adhesion to the substrate surface. Difficulties in obtaining a sufficiently thin coating to achieve increased light transmissivity may also be encountered at concentrations above about 5 weight percent. At concentrations below 0.5 weight percent, process inefficiencies result due to the large amount of liquid which must be removed and beneficial properties may be reduced.

The thickness of the applied wet coating solution is dependent on the concentration of silica particles and alkali metal orthosilicate in the coating solutions and the desired thickness of the dried coatings. The thickness of the wet coating solution is preferably such that the resulting dried coating thickness is from about 25 to 1000 nm, more preferably the dried coating is about 100 to 350 nm thick.

The coating solution may also optionally contain a surfactant to improve wettability of the solution on the substrate, but inclusion of an excessive amount of surfactant may reduce the adhesion of the coating to the substrate. Suitable surfactants for this system would include compatible surface-tension reducing organic liquids such as n-propanol, and non-ionic surfactants such as those sold under the commercial names of Triton TM X-100 and 10G. Generally the surfactant can be used in amounts of up to about 0.5 weight percent of the solution.

The average primary particle size of the colloidal inorganic oxide particles is generally less than 50 nm, preferably less than 20 nm, and more preferably less than 10 nm. Some very useful commercial colloidal suspensions have average primary particle sizes less than 7 nm. Examples of commercially available colloidal inorganic silica solutions are Ludox TM SM30 and Remasol SP-30.

Measurement of antistatic property: the method used to measure the effectiveness of the antistatic layer employed an ets Static Decay Meter, Model # 406C that was utilized to measure the time in seconds for an applied surface electric charge of +5000 volts to decay to 'zero'. This will be referred to as the Charge Decay (CD) time.

EXAMPLE 1

A solution of sodium ortho silicate was prepared by dissolving 0.46 g of sodium orthosilicate $Na_4SiO_4$ in 95.5 g water. The following were added in order, 4.5 g of the silica sol ($SiO_2$) Remasol SP-30 (30% solids), 0.1 g of 10% Triton# X-100 surfactant, 0.135 g of 3-aminopropyltriethyoxysilane. The above mixture was coated on photographic grade polyester primed with a copolymer poly (vinylidene chloride, ethyl acrylate, itaconic acid). A control coating was made in which the sodium orthosilicate was absent. The coatings were made using a #12 wire wound rod and dried in a forced air oven for 2 minutes at 55° C. Two other coatings were made as described above. One of the coatings was overcoated with the following mixture:

| | |
|---|---|
| x-ray silver halide emulsion | 100 g |
| Water | 50 g |
| 20% poly ethylacrylate latex | 11 g |
| 10%% solution of anionic surfactant | 2.25 g |
| 3.75% formaldehyde solution | 1.00 g |

A second coating was overcoated with an antihalo mixture for IR x-ray film with 1.0 g of 3.75% formaldehyde solution added just before coating. Both of the above overcoatings were made with a #24 wire wound rod, air dried for 5 minutes and then dried 2 minutes at 55° C. in a forced air oven. The above film constructions were conditioned overnight together with the control coatings in a room at 25% Relative Humidity and 20° C. The film constructions were tested for static decay on the ets Static Decay Meter with the measurements being made in the conditioning room. The overcoated film constructions were processed by hand in fresh x-ray developer-replenisher (25 sec.), x-ray fix (25 sec.) and water wash (25 sec.) followed by drying 90 seconds at 55° C. in a forced air oven. The processed films were returned to the 25% Relative Humidity room for 4 hours before measuring static decay. The static decay results follow.

ets Static Decay Readings (5.0 Kv to 0.0 Kv)

| Coating Description | (Before Process) + Decay | (Before Process) − Decay | (After Process) + Decay | (After Process) − Decay |
|---|---|---|---|---|
| $Na_4SiO_4 + SiO_2$. | .03 sec. | .02 sec | — | — |
| $Na_4SiO_4 + SiO_2$ w/emulsion | .28 | .20 | .28 | .10 |
| $Na_4SiO_4 + SiO_2$ w/AH | .15 | .09 | .11 | .04 |
| $SiO_2$ control | 3.56 | 2.74 | — | — |
| $SiO_2$ control w/emulsion | ∞ | ∞ | — | — |
| $SiO_2$ control w/AH | ∞ | ∞ | — | — |

∞ indicates the film construction is an insulator.

The above processed films were then tested for dry adhesion by scoring in a cross hatch pattern, attaching 2 inch wide 3M #610 tape firmly to the surface and then rapidly peeling off the test was repeated 5 times on the same area. No evidence of dry adhesion failure was noted on either the emulsion or antihalo overcoated samples.

EXAMPLE 2

A mixture was prepared by adding 4.5 g of the silica sol Remasol SP-30 to 87.5 g of water. The following additions were made in order: 0.30 g I0% Triton TM x-I00 surfactant, 0.135 g 3-aminopropyltriethoxysilane and 7.6 g of a 5% solution of sodium orthosilicate. Coatings were made as described in Example 1 above using both a #12 wire wound rod and in order to obtain a thicker coating, a #24 wire wound rod. These coatings were then overcoated with the x-ray emulsion described in Example 1. The film constructions were then conditioned 13 hours at 25% Relative Humidity and 20° C. and then the static decay measured on the ets Static Decay Meter. The data below indicates that the thicker coating made with the #24 rod and estimated at 2000 Å has a faster decay than the coating made with the #12 rod and measured to be 1150 Å.

| ets Static Decay Readings (5.0 Kv to 0.0 Kv) | | |
|---|---|---|
| Coating Description | + Decay | − Decay |
| $Na_4SiO_4$ + $SiO_2$ (#12 rod) | .06 sec. | .04 sec. |
| $Na_4SiO_4$ + $SiO_2$ (#12) w/emulsion | .70 | .43 |
| $Na_4SiO_4$ + $SiO_2$ (#24) w/emulsion | .05 | .03 |

EXAMPLE 3

A mixture containing sodium orthosilicate was prepared as described in Example 1. The mixture was coated on 7 mil blue polyester that had been flame treated at a web speed of 100 m/min. and an air to fuel ratio of 9.0:1.0. The coating was then overcoated with an antihalo layer (AH) as described in Example 1. A control (standard 7 mil subbed 3M photographic base) was also coated with the antihalo layer. The film constructions were equilibrated at 25% Relative Humidity and 20° C. and then the static decay was measured as described in Example 1.

| ets Static Decay Readings (5.0 Kv to 0.0 Kv) | | | | |
|---|---|---|---|---|
| | (Before Process) | | (After Process) | |
| Coating Description | + Decay | − Decay | + Decay | − Decay |
| $Na_4SiO_4$ + $SiO_2$ w/AH | .08 sec | .07 sec | .22 sec. | .18 sec. |
| Std. Photo Base w/AH | ∞ | ∞ | — | — |

∞ indicates the film construction behaves as an insulator.

EXAMPLE 4

Three solutions of sodium orthosilicate were labeled A, B and C and prepared by dissolving 1.71 g, 1.38 g and 1.05 g, respectively, in 213 g quantities of deionized water. Remasol SP-30 silica (13.5g), 3-aminopropyltriethoxy silane (0.354g) and a 10% solution of Triton TM X-100 (0.30 g) were in turn added to each. The 3 mixtures were then heated for 32 minutes in a water bath maintained at 52° C. followed by rapid cooling to 20° C. The mixtures were then coated on photographic grade polyester primed with the copolymer poly (vinylidene chloride, ethyl acrylate, itaconic acid). The coatings were made using a #12 wire wound rod and drying was 90 seconds in a forced air oven at 55° C. The resultant clear coatings were then overcoated with the following mixture.

| | |
|---|---|
| x-ray silver halide emulsion | 100 g |
| water | 50 g |
| 20% poly ethyl acrylate latex | 5.5 g |
| 10% solution of anionic surfactant | 2.2 g |
| 3.75% solution of formaldehyde | 2.0 g |

The above mixture was overcoated on the above coatings A, B and C using a #24 wire wound rod followed by drying 2 minutes at room temperature and then 2 minutes at 55° C. The resultant coatings were allowed to remain 30 days at ambient room conditions. The coatings were then conditioned at 25% relative humidity (20° C.) and the static decay measured on the ets Static Decay Meter. The coatings were then further conditioned at 10% relative humidity (20° C) and the static decay remeasured. The static decay results are given in the following table.

| ets Static Decay Readings (5.0 Kv to 0.0 Kv) | | |
|---|---|---|
| Coating ID | + Decay (25% R.H.) | + Decay (10% R.H.) |
| A | .13 second | .18 second |
| B | .09 | .14 |
| C | .10 | .24 |

EXAMPLE 5

A solution was prepared by dissolving 1.71 g of sodium orthosilicate in 180 g of water. Remasol SP-30 (13.5g), 3-aminopropylthriethoxy silane (0.354g) and a 10% solution of Triton TM x-100 (0.30g) Were added slowly with stirring. The mixture was placed in a water bath preheated to 52° C. and allowed to stand with occasional stirring for 32 minutes. The mixture was then rapidly cooled to 20° C. The pH was then lowered from 11.5 to 10.6 via the addition of 15.9 ml of IM $HNO_3$.

The mixture was then coated on polyester film and dried as described in Example 4. The coating was then overcoated with a photographic antihalo dye-gelatin combination containing a divinyl sulfone hardener for the gelatin. The coating and drying methods are described in Example 4. The coating was then conditioned 18 hours at 25% relative humidity (20° C.). The static decay from 5.0 Kv to 0.0 Kv as read on the ets Static Decay Meter was measured as 0.06 seconds. The coating was further conditioned for 5 hours at 10% relative humidity (20° C.) and the static decay measured as 22 seconds. The wet adhesion of the gelatin coating to the substrate was measured by immersing a sample in x-ray developer for 30 seconds, removing and placing on a flat surface and while still wet with developer scoring in a cross hatch pattern with the tip of a razor blade and then rubbing the surface vigorously in a back and forth motion 16 times. No evidence of adhesion failure was detected.

The dry adhesion test was made as described in Example 1 and no removal of the antihalo layer was detected.

What is claimed is:

1. A method for providing an antistatic protection layer onto a substrate comprising:

a) providing a coating composition of an antistatic effective amount of a colloidal silica, alkali metal orthosilicate, and a coupling agent for said colloidal silica;

b) coating said composition onto said substrate; and c) drying said composition.

2. The method of claim 1 wherein the alkali metal orthosilicate is sodium orthosilicate.

3. The method of claim 2 wherein the coating composition contains a colloidal silica to sodium orthosilicate ratio of 1/1 to 8.5/1 by weight.

4. The method of claim 3 wherein the coating composition contains a colloidal silica to sodium orthosilicate ratio of 1.7/1 to 3.0/1 by weight.

5. The method of claim 1 wherein the colloidal silica employed is stabilized by sodium hydroxide.

6. The method of claim 1 wherein the coupling agent comprises a silane coupling agent.

7. The method of claim 1 wherein the coupling agent is 3-aminopropyltriethoxy silane.

8. The method of claim 1 wherein the coupling agent is 3-glycidoxypropyltrimethoxy silane.

9. The method of claim 1 wherein the percent solids of the coating composition expressed as colloidal silica plus sodium orthosilicate ranges from 0.5% to 5.0%.

10. The method of claim 9 wherein the percent solids of the coating composition expressed as colloidal silica plus sodium orthosilicate ranges from 2.0% to 4.0%.

11. The method of claim 1 in which the pH of the coating composition ranges from 10.0 to 12.0.

12. The method of claim 1 in which the pH of the coating composition is adjusted with nitric acid.

13. The method of claim 1 wherein drying of said composition forms a film having a thickness of from 25 to 1000 nm.

14. The method of claim 1 wherein drying of said composition forms a film having a thickness of from 100 to 350 nm.

15. The method of claim 1 wherein said antistatic coating of claim 1 is overcoated with a gelatin matrix.

16. The method of claim 15 wherein said gelatin matrix contains a photographic silver halide emulsion or an antihalation dye.

17. The method of claim 18 wherein the gelatin matrix contains a polyalkyl acrylate latex.

18. The method of claim 17 wherein the polyalkyl acrylate is present in a weight ratio of polyalkyl acrylate to gelatin of from 0.05/1 to 1.0/1.

19. The method of claim 19 wherein the gelatin matrix contains a photographic silver halide emulsion or an antihalation dye and a polyalkyl acrylate latex.

20. The method of claim 19 wherein the polyalkyl acrylate is present in a weight ratio of gelatin to polyalkyl acrylate of from 0.05/1 to 1.0/1.

* * * * *